US009105365B2

(12) United States Patent
Singh et al.

(10) Patent No.: US 9,105,365 B2
(45) Date of Patent: Aug. 11, 2015

(54) METHOD FOR CONTROLLING TEMPERATURE OF A PORTION OF A RADIOACTIVE WASTE STORAGE SYSTEM AND FOR IMPLEMENTING THE SAME

(71) Applicants: Krishna P. Singh, Hobe Sound, FL (US); Richard M. Springman, Drexel Hill, PA (US)

(72) Inventors: Krishna P. Singh, Hobe Sound, FL (US); Richard M. Springman, Drexel Hill, PA (US)

(73) Assignee: Holtec International, Inc.

( * ) Notice: Subject to any disclaimer, the term of this patent is extended or adjusted under 35 U.S.C. 154(b) by 0 days.

(21) Appl. No.: 14/354,851

(22) PCT Filed: Oct. 29, 2012

(86) PCT No.: PCT/US2012/062470

§ 371 (c)(1),
(2) Date: Apr. 28, 2014

(87) PCT Pub. No.: WO2013/085638

PCT Pub. Date: Jun. 13, 2013

(65) Prior Publication Data

US 2014/0247916 A1 Sep. 4, 2014

Related U.S. Application Data

(60) Provisional application No. 61/552,606, filed on Oct. 28, 2011.

(51) Int. Cl.
*G21F 5/10* (2006.01)
*G21F 5/06* (2006.01)

(52) U.S. Cl.
CPC ... *G21F 5/10* (2013.01); *G21F 5/06* (2013.01)

(58) Field of Classification Search
CPC ..... G21F 5/10
USPC ..... 376/272; 454/9, 258
See application file for complete search history.

(56) References Cited

U.S. PATENT DOCUMENTS 3,111,078 A 11/1963 Breckenridge
3,111,586 A 11/1963 Rogers (Continued)

FOREIGN PATENT DOCUMENTS

CN 1345452 A 4/2002
DE 2821780 11/1979

(Continued)

OTHER PUBLICATIONS

International Atomic Energy Agency, "Multi-purpose container technologies for spent fuel management," Dec. 2000 (IAEA-TECDOC-1192) pp. 1-49.

(Continued)

*Primary Examiner* — Jack W Keith
*Assistant Examiner* — Sean P Burke
(74) *Attorney, Agent, or Firm* — The Belles Group, P.C.

(57) ABSTRACT

A system and method for storing radioactive waste, such as spent nuclear fuel, in one embodiment, the invention is a method of controlling temperature of a portion of a storage system comprising a container loaded with radioactive waste and a ventilated module in which the container is positioned, the ventilated module configured so that heat generated by the radioactive waste causes a natural convective flow of air through, a ventilation passageway of the ventilated module, the method comprising; throttling the natural convective flow of the air through the ventilated module to alter a heat rejection rate of the storage system to compensate for a decreasing heat generation rate of the radioactive waste to maintain the portion of the storage system within a predetermined temperature range.

26 Claims, 5 Drawing Sheets

(56) References Cited

U.S. PATENT DOCUMENTS

| | | | | |
|---|---|---|---|---|
| 3,629,062 | A | | 12/1971 | Muenchow |
| 3,739,451 | A | | 6/1973 | Jacobson |
| 3,745,707 | A | | 7/1973 | Herr |
| 3,755,079 | A | | 8/1973 | Weinstein et al. |
| 3,765,549 | A | | 10/1973 | Jones |
| 3,800,973 | A | | 4/1974 | Weaver |
| 3,836,267 | A | | 9/1974 | Schatz |
| 3,910,006 | A | | 10/1975 | James |
| 3,917,953 | A | | 11/1975 | Wodrich |
| 3,935,062 | A | | 1/1976 | Keller et al. |
| 3,945,509 | A | | 3/1976 | Weems |
| 3,962,587 | A | | 6/1976 | Dufrane et al. |
| 3,984,942 | A | | 10/1976 | Schroth |
| 4,055,508 | A | | 10/1977 | Yoli et al. |
| 4,078,968 | A | | 3/1978 | Golden et al. |
| 4,158,599 | A | | 6/1979 | Andrews et al. |
| 4,278,892 | A | | 7/1981 | Baatz et al. |
| 4,288,698 | A | | 9/1981 | Baatz et al. |
| 4,336,460 | A | | 6/1982 | Best et al. |
| 4,355,000 | A | | 10/1982 | Lumelleau |
| 4,356,146 | A | | 10/1982 | Knappe |
| 4,366,095 | A | | 12/1982 | Takats et al. |
| 4,394,022 | A | | 7/1983 | Gilmore |
| 4,450,134 | A | | 5/1984 | Soot et al. |
| 4,498,011 | A | | 2/1985 | Dyck et al. |
| 4,525,324 | A | | 6/1985 | Spilker et al. |
| 4,526,344 | A | | 7/1985 | Oswald et al. |
| 4,527,066 | A | | 7/1985 | Dyck et al. |
| 4,532,104 | A | | 7/1985 | Wearden et al. |
| 4,532,428 | A | | 7/1985 | Dyck et al. |
| 4,585,611 | A | | 4/1986 | Perl |
| 4,634,875 | A | | 1/1987 | Kugeler et al. |
| 4,635,477 | A | | 1/1987 | Simon |
| 4,649,018 | A | | 3/1987 | Waltersdorf |
| 4,663,533 | A | | 5/1987 | Kok et al. |
| 4,666,659 | A | | 5/1987 | Lusk |
| 4,671,326 | A | | 6/1987 | Wilhelm |
| 4,683,533 | A | | 7/1987 | Shiozaki et al. |
| 4,690,795 | A | | 9/1987 | Hardin et al. |
| 4,730,663 | A | | 3/1988 | Volkl et al. |
| 4,764,333 | A | | 8/1988 | Minshall et al. |
| 4,780,269 | A | | 10/1988 | Fischer et al. |
| 4,800,062 | A | | 1/1989 | Craig et al. |
| 4,834,916 | A | | 5/1989 | Chaudon et al. |
| 4,847,009 | A | | 7/1989 | Madle et al. |
| 4,851,183 | A | | 7/1989 | Hampel |
| 4,971,752 | A | | 11/1990 | Parker |
| 5,102,615 | A | | 4/1992 | Grande et al. |
| 5,182,076 | A | | 1/1993 | de Seroux et al. |
| 5,205,966 | A | | 4/1993 | Elmaleh |
| 5,267,280 | A | | 11/1993 | Duquesne |
| 5,297,917 | A | | 3/1994 | Freneix |
| 5,307,388 | A | | 4/1994 | Inkester et al. |
| 5,319,686 | A | | 6/1994 | Pizzano et al. |
| 5,387,741 | A | | 2/1995 | Shuttle et al. |
| 5,448,604 | A | * | 9/1995 | Peterson, II ..... 376/261 |
| 5,469,936 | A | | 11/1995 | Lauga et al. |
| 5,513,231 | A | | 4/1996 | Jones et al. |
| 5,513,232 | A | | 4/1996 | Jones et al. |
| 5,546,436 | A | | 8/1996 | Jones et al. |
| 5,564,498 | A | | 10/1996 | Bochard |
| 5,633,904 | A | | 5/1997 | Gilligan et al. |
| 5,646,971 | A | | 7/1997 | Howe |
| 5,661,768 | A | | 8/1997 | Gilligan et al. |
| 5,753,925 | A | | 5/1998 | Yamanaka et al. |
| 5,771,265 | A | | 6/1998 | Montazer |
| 5,852,643 | A | | 12/1998 | Copson |
| 5,862,195 | A | | 1/1999 | Peterson |
| 5,898,747 | A | | 4/1999 | Singh |
| 5,926,602 | A | | 7/1999 | Okura |
| 6,064,710 | A | | 5/2000 | Singh |
| 6,064,711 | A | | 5/2000 | Copson |
| 6,074,771 | A | | 6/2000 | Cubukcu et al. |
| 6,252,923 | B1 | | 6/2001 | Iacovino et al. |
| 6,452,994 | B2 | | 9/2002 | Pennington |
| 6,489,623 | B1 | | 12/2002 | Peters et al. |
| 6,519,307 | B1 | | 2/2003 | Singh et al. |
| 6,519,308 | B1 | | 2/2003 | Boardman |
| 6,718,000 | B2 | | 4/2004 | Singh et al. |
| 6,793,450 | B2 | | 9/2004 | Singh |
| 6,853,697 | B2 | | 2/2005 | Singh et al. |
| 7,068,748 | B2 | | 6/2006 | Singh |
| 7,185,512 | B2 | * | 3/2007 | Badie et al. ..... 62/515 |
| 7,294,375 | B2 | | 11/2007 | Taniuchi et al. |
| 7,590,213 | B1 | | 9/2009 | Singh |
| 8,351,562 | B2 | | 1/2013 | Singh |
| 2006/0251201 | A1 | | 11/2006 | Singh |
| 2010/0150297 | A1 | | 6/2010 | Singh |
| 2010/0284506 | A1 | | 11/2010 | Singh |

FOREIGN PATENT DOCUMENTS

| | | |
|---|---|---|
| DE | 3107158 | 1/1983 |
| DE | 3144113 | 5/1983 |
| DE | 3151475 | 5/1983 |
| DE | 3404666 | 8/1985 |
| DE | 3515871 | 11/1986 |
| DE | 195 29 357 | 8/1995 |
| EP | 0253730 | 1/1998 |
| EP | 1 061 011 | 6/2000 |
| EP | 1312874 | 5/2003 |
| FR | 2434463 | 8/1979 |
| GB | 2295484 | 5/1996 |
| GB | 2327722 | 1/1999 |
| GB | 2337722 | 1/1999 |
| JP | 59193000 | 11/1984 |
| JP | 62-185199 | 8/1987 |
| JP | 10297678 | 11/1998 |
| JP | 2001056392 | 2/2001 |
| JP | 2001141891 | 5/2001 |
| JP | 2001264483 | 9/2001 |
| JP | 2003207597 | 7/2003 |
| JP | 2003240894 | 8/2003 |
| JP | 2004233055 | 8/2004 |
| RU | 2168022 | 6/2000 |

OTHER PUBLICATIONS

U.S. Department of Energy, "Conceptual Design for Waste-Management System that Uses Multipurpose Canisters," Jan. 1994 pp. 1-14.

Federal Register Environmental Documents, "Implementation Plan for the Environmental Impact Statement for a Multi-Purpose Canister System for Management of Civilian and Naval Spent Nuclear Fuel," Aug. 30, 1995 (vol. 60, No. 168) pp. 1-7.

National Conference of State Legislatures, "Developing a Multipurpose Canister System for Spent Nuclear Fuel," State Legislative Report, col. 19, No. 4 by Sia Davis et al., Mar. 1, 1994, pp. 1-4.

Energy Storm Article, "Multi-purpose canister system evaluation: A systems engineering approach," Author unavailable, Sep. 1, 1994 pp. 1-2.

Science, Society, and America's Nuclear Waste—Teacher Guide, "The Role of the Multi-Purpose Canister in the Waste Management System," Author—unknown, Date—unknown, 5 pgs.

USEC Inc. Article, "NAC International: A Leader in Used Fuel Storage Technologies," copyright 2008, 2 pages.

Federal Register Notice, Dept. of Energy, "Record of Decision for a Multi-Purpose Canister or Comparable System," vol. 64, No. 85, May 4, 1999.

Zorpette, Glenn: "Cannet Heat", Nuclear Power, Special Report, in IEEE Spectrum, Nov. 2001, pp. 44-47.

Optimization Strategies for Cask Design and Container Loading in Long Term Spent Fuel Storage, Dec. 2006 [retrieved on Jan. 23, 2013]. Retrieved from the Internet:<URL: http://www-pub.iaea.org/MTCD/publications/PDF/te_1523_web.pdf (US).

International Search Report and Written Opinion of the International Searching Authority for PCT/US2012/62470, mailed Feb. 21, 2013. WO.

* cited by examiner

METHOD FOR CONTROLLING TEMPERATURE OF A PORTION OF A RADIOACTIVE WASTE STORAGE SYSTEM AND FOR IMPLEMENTING THE SAME

CROSS-REFERENCE TO RELATED PATENT APPLICATIONS

The present application claims priority as a national stage application, under 35 U.S.C. 371, to international application No. PCT/US2012/062470, filed Oct. 29, 2012, which claims priority to U.S. Provisional Patent Application Ser. No. 61/552,606, filed Oct. 28, 2011. The disclosures of the aforementioned priority applications are incorporated herein by reference in their entirety.

FIELD OF THE INVENTION

The present invention relates generally to a system and method for storing radioactive waste, such as spent nuclear fuel and/or other high level radioactive waste, and specifically to a ventilated storage system, such as an overpack system or vault, that is used in the nuclear industry to provide physical protection and/or radiation shielding to canisters containing radioactive waste that generates heat.

BACKGROUND OF THE INVENTION

In the operation of nuclear reactors, it is customary to remove fuel assemblies after their energy has been depleted down to a predetermined level. Upon removal, this spent nuclear fuel ("SNF") is still highly radioactive and produces considerable heat, requiring that great care be taken in its packaging, transporting, and storing. In order to protect the environment from radiation exposure, SNF is first placed in a canister, which is typically a hermetically sealed canister that creates a confinement boundary about the SNF. The loaded canister is then transported and stored in a large cylindrical container called a cask. Generally, a transfer cask is used to transport spent nuclear fuel from location to location while a storage cask is used to store SNF for a determined period of time.

One type of storage cask is a ventilated vertical overpack ("VVO"). A VVO is a massive structure made principally from steel and concrete and is used to store a canister loaded with spent nuclear fuel. VVOs come in both above-ground and below-grade versions. In using a VVO to store SNF, a canister loaded with SNF is placed in the cavity of the body of the VVO. Because the SNF is still producing a considerable amount of heat when it is placed in the VVO for storage, it is necessary that this heat energy have a means to escape from the VVO cavity. This heat energy is removed from the outside surface of the canister by ventilating the VVO cavity. In ventilating the VVO cavity, cool air enters the VVO chamber through air-inlet ducts, flows upward past the loaded canister as it is warmed from the heat emanating from the canister, and exits the VVO at an elevated temperature through air-outlet ducts. Such VVOs do not require the use of equipment to force the air flow through the VVO. Rather, these VVOs are passive cooling systems as they use a natural convective flow of air induced by the heated air to rise within the VVO (also know as the chimney effect).

While it is necessary that the VVO cavity be vented so that heat can escape from the canister, it is also imperative that the VVO provide adequate radiation shielding and that the SNF not be directly exposed to the external environment. Being that VVOs (and the canisters loaded therein) are intended to be used as long term storage solutions for SNF, it is imperative that both VVOs and the canisters exhibit a long life in which corrosion, cracking and/or any type of compromise of structural integrity is minimized and/or avoided entirely. Thus, a need exists for systems and methods of storing radioactive waste in which corrosion, cracking and other types of compromise of structural integrity is minimized and/or prevented.

SUMMARY OF THE INVENTION

Stress Corrosion Cracking (SCC) of stainless steel nuclear waste canisters and containers in storage at coastal sites with harsh marine environments is an important issue receiving increased industry and regulatory scrutiny. The root causes of SCC are present to some degree in all high level radioactive waste ("HLW") storage and transport canisters: (i) sensitization caused by heating; (ii) stress; and (iii) the presence of corrosive elements. Canister designers and manufactures takes preventative measures to minimize the chance of SCC developing by maintaining controlled temperatures during welding processes and engineering large conservative margins into our canisters to keep stresses at a minimum.

Investigations on SCC have demonstrated that SCC has a strong dependence on the surface temperature of the stainless steel canister. The dependence on the surface temperature is driven by the mechanism of deposit of airborne containments (e.g. chlorides) and subsequent deliquesce of those containments on the stainless steel surface. A higher surface temperature decreases the relative humidity of the air adjacent to the surface and prevents deliquesce the contaminants and subsequent penetration into the stainless steel surface, a precursor for SCC.

The canister surface temperature of a ventilated storage system depends on the heat generation rate of the canister contents and the overall heat rejection rate of the storage system (i.e., heat transfer rate to the surrounding environment). Due to the high heat generation rates of SNF during the first 20 years of storage, SCC is not believed to be a problem for canisters loaded with SNF due to the surface temperature dependence on the deliquesce of the salt deposits that may be carried by the cooling air in a marine environment. However, as the heat generation rate of the SNF subsides due to radioactive decay processes, the canister surface temperature will decrease and, therefore, the canister may become prone to SCC. Data suggests the critical temperature at which deliquesce and subsequent SCC begins to occur is below 85° C.

The ventilation passageway is the dominant mechanism in a ventilated storage system by which heat is rejected to the surrounding environment. Thus, according to the present invention, controlled throttling of the natural convective flow of airflow by, for example, opening or closing the ventilation passageway can be used to maintain the temperature above the threshold value at which deliquesce of surface salt deposits and subsequent SCC begins to occur.

For this application, the invention involves a throttle to control the flow of air through the ventilation passageway to maintain the temperature of the surface of the canister above a lower threshold limit in which salt deposition and SCC is known to occur.

Additionally, the ventilated module of the storage system, which typically has a concrete exterior surface tends to be prone to cracking due to freeze-thaw cycles associated with normal weather patterns. Deposit and subsequent freezing of moisture on the porous concrete surface can induce cracking and delamination of the concrete. Heat generated by canisters loaded with SNF (or other heat-generating radioactive waste) maintains the temperature of a concrete storage system above the freezing temperature in most environments until the heat generation rate of the SNF drops below a critical value. During extended storage conditions, this can result in degradation of the exposed concrete and increases in radiation levels due to the loss in ability of the concrete to provide shielding (e.g. cracking, etc.).

For this application, the invention involves a throttle to control the flow of air through the ventilation passageway to maintain the temperature of the outer surface of ventilated module above the temperature at which freezing of water on the outer surface of the ventilated module occurs.

In one embodiment, the invention can be a method of storing radioactive waste in a storage system comprising a container and a ventilated module, the method comprising: a) positioning the container loaded with radioactive waste in the ventilated module, the ventilated module configured so that heat generated by the radioactive waste causes a natural convective flow of air through a ventilation passageway of the storage system; and b) throttling the natural convective flow of the air through the ventilation passageway to maintain a portion of the storage system at a temperature within a predetermined range over a period of time to compensate for decreasing heat generation rate of the radioactive waste.

In another embodiment, the invention can be a method of controlling temperature of a portion of a storage system comprising a container loaded with radioactive waste and a ventilated module in which the container is positioned, the ventilated module configured so that heat generated by the radioactive waste causes a natural convective flow of air through a ventilation passageway of the ventilated module, the method comprising: a) determining a desired temperature range of the portion of the storage system; b) determining a heat generation rate of the radioactive materials as a function of time; c) determining, based on the results of step a), a temperature of the portion of the storage system as a function of time and as a function of an obstruction percent of the ventilation passageway; and d) obstructing the ventilation passageway in accordance with the functions of step c) to maintain the portion of the storage system within the desired temperature range.

In yet another embodiment, the invention can be a method of controlling temperature of a portion of a storage system comprising a container loaded with radioactive waste and a ventilated module in which the container is positioned, the ventilated module configured so that heat generated by the radioactive waste causes a natural convective flow of air through a ventilation passageway of the ventilated module, the method comprising: throttling the natural convective flow of the air through the ventilated module to alter a heat rejection rate of the storage system to compensate for a decreasing heat generation rate of the radioactive waste to maintain the portion of the storage system within a predetermined temperature range.

In still another embodiment, the invention can be a system for storing radioactive waste comprising: a ventilated module; a container loaded with radioactive waste positioned within the ventilated module, the ventilated module configured so that heat generated by the radioactive waste causes a natural convective flow of air through a ventilation passageway of the ventilated module; and a throttle mechanism operably coupled to the ventilation module to throttle the natural convective flow of the air through the ventilation passageway.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
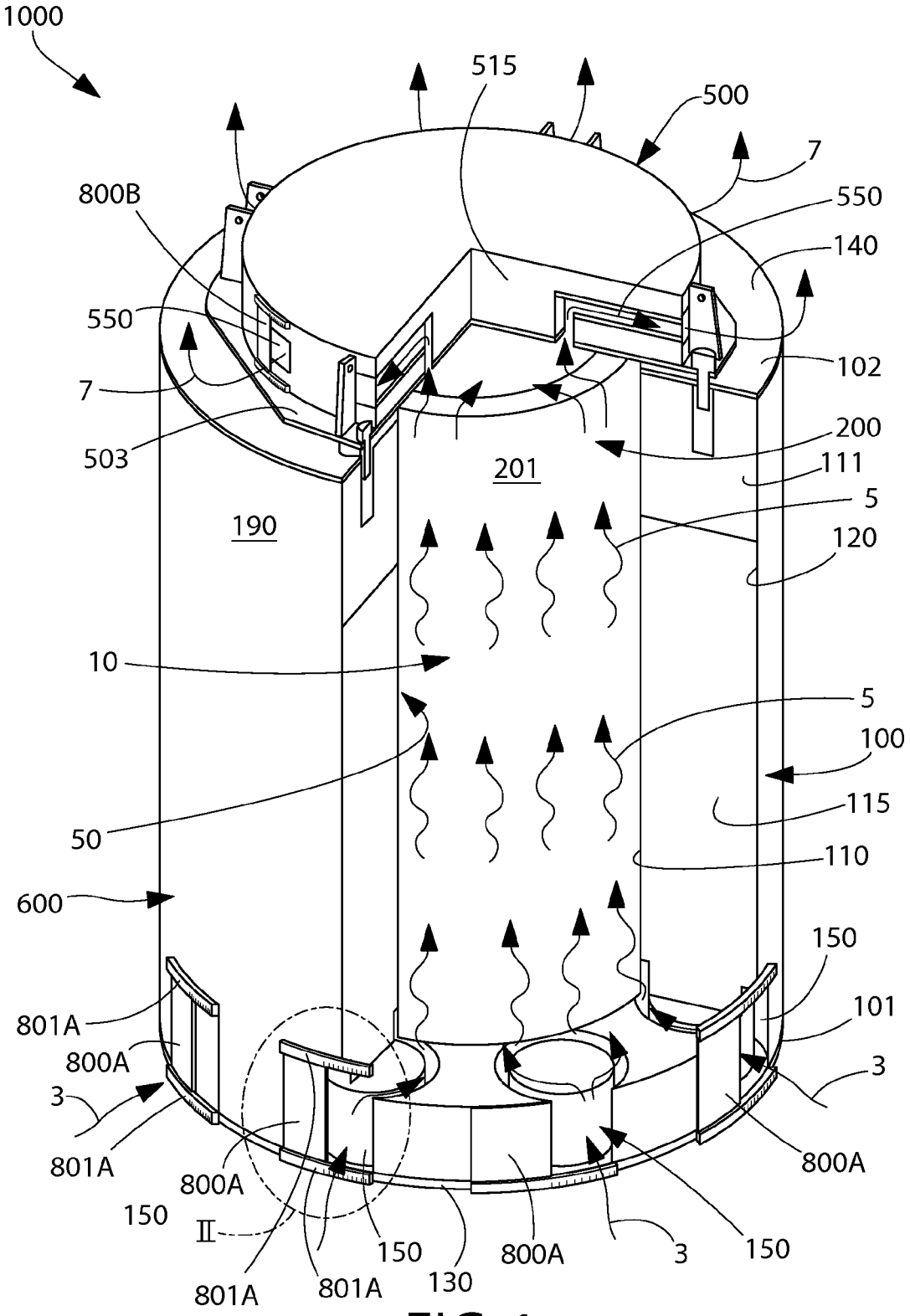
FIG. 1 is a perspective view of a storage system according to an embodiment of the present invention, wherein a portion of the ventilated module has been cut-away.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, a ventilated storage system 1000 according to an embodiment of the present invention is illustrated. The ventilated storage system 1000 is a vertical, ventilated, dry, SNF storage system that is fully compatible with 1000 ton and 125 ton transfer casks for spent fuel canister transfer operations. The ventilated storage system 1000 can, of course, be modified and/or designed to be compatible with any size or style of transfer cask. Moreover, while the ventilated storage system 1000 is discussed herein as being used to store SNF, it is to be understood that the invention is not so limited and that, in certain circumstances, the ventilated storage system 1000 can be used to store other forms of radioactive waste that is emitting a heat load.

The ventilated storage system 1000 generally comprises a container 200 and a ventilated module 600. The container 200 forms a fluidic containment boundary about the SNF loaded therein. Thus, the container 200 can be considered a hermetically sealed pressure vessel. The container 200, however, is thermally conductive so that heat generated by the SNF loaded therein is conducted to its outer surface where it can be removed by convection. In one embodiment, the canister 200 is formed of a stainless steel due to its corrosion resistant nature. In other embodiments, the canister 200 can be formed of other metals or metal alloys. Suitable canisters include multi-purpose canisters ("MPCs") and, in certain instances, can include thermally conductive casks that are hermetically sealed for the dry storage of high level radioactive waste. Typically, such canisters comprise a honeycomb basket, or other structure, positioned therein to accommodate a plurality of SNF rods in spaced relation. An example of an MPC that is particularly suited for use in the ventilated storage system 1000 is disclosed in U.S. Pat. No. 5,898,747, issued to Singh on Apr. 27, 1999, the entirety of which is hereby incorporated by reference. Another MPC that is particularly suited for use in the ventilated storage system 1000 is disclosed in U.S. Pat. No. 8,135,107, issued to Singh et al. on Mar. 13, 2012, the entirety of which is hereby incorporated by reference.

The ventilated module 600 is designed to accept the container 200. The ventilated module 600, in the exemplified embodiment is in the forms of a ventilated vertical overpack ("VVO"). However, in other embodiments, the ventilated module 600 can take on a wide variety of structures, including any type of structure that is used to house the container 200 and provide adequate radiation shielding for the SNF loaded within the container 200.

The ventilated module 600, in the exemplified embodiment, comprises two major parts: (1) a dual-walled cylindrical overpack body 100 which comprises a plurality of air-inlet ducts 150 at or near its bottom extremity; and (2) a removable top lid 500 which comprises a plurality of air-outlet vents 550. The overpack body 100 forms an internal cylindrical storage cavity 10 of sufficient height and diameter for housing the container 200 fully therein. The cavity 10 preferably has a horizontal (i.e., transverse to the axis A-A) cross-section that is sized to accommodate only a single container 200. However, in other embodiments, the cavity 10 may house multiple canisters 200 in a side-by-side relationship.

The overpack body 100 extends from a bottom end 101 to a top end 102. A base plate 130 is connected to the bottom end 101 of the overpack body 100 so as to enclose the bottom end of the cavity 10. The base plate 130 hermetically encloses the bottom end 101 of the overpack body 100 (and the storage cavity 10) and forms a floor for the storage cavity 10. When loaded in the ventilated module 600, the container 200 is in a co-axial disposition with the central vertical axis of the ventilated module 600.

The overpack body 100 is a rugged, heavy-walled cylindrical vessel. The main structural function of the overpack body is provided by its carbon steel components while the main radiation shielding function is provided by an annular plain concrete mass 115. The plain concrete mass 115 of the overpack body 100 is enclosed by concentrically arranged cylindrical steel shells 110, 120, the thick steel baseplate 130, and a top steel annular plate 140. A set of four equispaced steel radial connector plates 111 are connected to and join the inner and outer shells 110, 120 together, thereby defining a fixed width annular space between the inner and outer shells 120, 110 in which the plain concrete mass 115 is poured. The plain concrete mass 115 between the inner and outer steel shells 120, 110 is specified to provide the necessary shielding properties (dry density) and compressive strength for the ventilated storage system 1000. The principal function of the concrete mass 115 is to provide shielding against gamma and neutron radiation.

The overpack lid 500 is a weldment of steel plates filled with a plain concrete mass 515 that provides neutron and gamma attenuation to minimize skyshine. The lid 500 is secured to a top end 101 of the overpack body 100 by a plurality of bolts that extend through bolt holes formed into a lid flange 503. When secured to the overpack body 100, surface contact between the lid 500 and the overpack body 100 forms a lid-to-body interface. The lid 500 is preferably non-fixedly secured to the body 100 and encloses the top end of the storage cavity 10 formed by the overpack body 100.

As mentioned above, the lid 500 comprises a plurality of air-outlet vents 550 that allow heated air within the storage cavity 10 to escape. The air-outlet vents 550 form passageways through the lid 500 that extend from openings in the bottom surface of the lid 500 to openings in the peripheral surface of the lid 500. While the air-outlet vents 550 form L-shaped passageways in the exemplified embodiment, any other tortuous or curved path can be used so long as a clear line of sight does not exist from the external environment into the cavity 10 through the air-outlet vents 550. The air-outlet vents 550 are positioned about the circumference of the lid 500 in a radially symmetric and spaced-apart arrangement. While the air-outlet vents 500 of the ventilated storage system 600 are located within the lid 500 in the exemplified embodiment, the air-outlet vents 550 can be located in the body 100 in other embodiments.

Additional details of the exemplified embodiment of the ventilated module 600 can be found in U.S. Patent Application Publication No. 2012/0284506, published on Nov. 11, 2012, the entirety of which is hereby incorporated by reference.

While in the exemplified embodiment the outer surface 190 of the ventilated module 600 is formed by the steel of the outer shell 120, in other embodiments, the outer surface of the ventilated module 600 may be formed by concrete. By way of example, another suitable ventilated module 600 that can be utilized in accordance with the principles of the present invention, as discussed below, is disclosed in U.S. Pat. No. 6,718,000, issued to Singh et al. on Apr. 6, 2004, the entirety of which is incorporated herein by reference. Other suitable structures that can be utilized as the ventilated module 600 in accordance with the principles of the present invention, as discussed below, are disclosed in: (1) U.S. Pat. No. 7,068,748, issued to Singh on Jun. 27, 2012; and (2) U.S. Pat. No. 7,330,526, issued to Singh on Feb. 12, 2008, the entireties of which are hereby incorporated by reference.

When the container 200 is loaded with SNF and positioned within the storage cavity 10, an annular space 50 is formed between an outer surface 201 of the container 200 and an inner surface of the overpack body 100 that forms the cavity 10. When so positioned, heat generated by the SNF within the container 200 conducts to the outer surface 201 of the container 200. This heat then warms the air located within the annular space 50. As a result of being heated, this warmed air 5 rises within the annular space 50 and eventually exits the ventilated module 600 via the air-outlet vents 550 of the lid 500 as heated air 7. Due to a thermosiphon effect created by the exiting heated air 7, cool air 3 is drawn into the air-inlet vents 150. This cool air 3 flows through the air-inlet vents 150 and is the drawn upward into the annular space 50 where it becomes heated and begins to rise, thereby creating a continuous cycle, known as the chimney-effect. Thus, the heat generated by the SNF within the container 200 causes a natural convective flow of air through a ventilation passageway of the ventilated storage system 600. In the exemplified embodiment, the ventilation passageway is collectively formed by the air-inlet vents 150, the annular space 50 and the air-outlet vents 550. In the exemplified embodiment, the ventilated storage system 600 is free of forced cooling equipment, such as blowers and closed-loop cooling systems. The rate of air flow through the ventilation passageway of the ventilated storage system 100 is governed, in part, by the heat generation rate of the SNF within the container 200. The greater the heat generation rate, the greater the natural convective flow of air through the ventilation passageway.

As will be discussed below, in accordance with the present invention, the ventilated storage system 600 further comprises a throttle mechanism which can be used to throttle the natural convective flow of air through the ventilation passageway which, in turn, can be used to control the temperature of a desired portion of the ventilated storage system 1000, such as the outer surface 201 of the container and/or the outer surface 190 of the ventilated module 600. As used herein, the term "throttle" includes both "throttling-up," which results in an increase in the natural convective flow of air through the ventilation passageway, and throttling-down," which results in a decrease in the natural convective flow of air through the ventilation passageway.

In the exemplified embodiment, the throttle mechanism comprises an air-inlet throttle mechanism, in the form of a plurality of throttle plates 800A, and an air-outlet throttle mechanism, in the form of a plurality of throttle plates 800B. The throttle plates 800A, 800B are adjustably coupled to the ventilate module 600. More specifically, the throttle plates 800A of the air-inlet throttle mechanism are adjustably coupled to the ventilation module 600 as to be capable of selectively obstructing the air-inlet vents 150 of the ventilation passageway. The throttle plates 800B of the air-outlet throttle mechanism, on the other hand, are adjustably coupled to the ventilation module 600 as to be capable of selectively obstructing the air-outlet vents 550 of the ventilation passageway. In the exemplified embodiment, the air-inlet throttle mechanism comprises a throttle plate 800A for each the air-inlet vents 150. Each of the throttle plates 800A is adjustably coupled to the overpack body 100 so as to be alterable to various selectable positions that obstruct a desired percentage of the air-inlet vent 150 to which it is coupled, thereby restricting (or increasing) the flow of the incoming cool air 3 in order to throttle (up or down) the natural convective flow of the air through the ventilation passageway. Similarly, the air-outlet throttle mechanism comprises a throttle plate 800B for each the air-outlet vents 550. Each of the throttle plates 800B is adjustably coupled to the lid 500 so as to be alterable to various selectable positions that obstruct a desired percentage of the air-outlet vent 550 to which it operably coupled, thereby restricting (or increasing) the flow of the exiting heated air 3 in order to throttle (up or down) the natural convective flow of the air through the ventilation passageway. As such, the throttle mechanism can be used to alter the heat rejection rate of the ventilated storage system 1000, thereby allowing a user to control the temperature of a desired portion of the ventilated storage system 1000, as will be discussed in greater detail below.

While in the exemplified embodiment the ventilated storage system 100 comprises both the air-inlet throttle mechanism and the air-outlet throttle mechanism, in other embodiments the ventilates storage system 1000 comprises only one of the air-inlet throttle mechanism or the air-outlet throttle mechanism. For example, in one embodiment, the air-outlet throttle mechanism is omitted while only the air-inlet throttle mechanism is included. In another embodiment, the air-inlet throttle mechanism is omitted while only the air-outlet throttle mechanism is included.

Figure 2A:
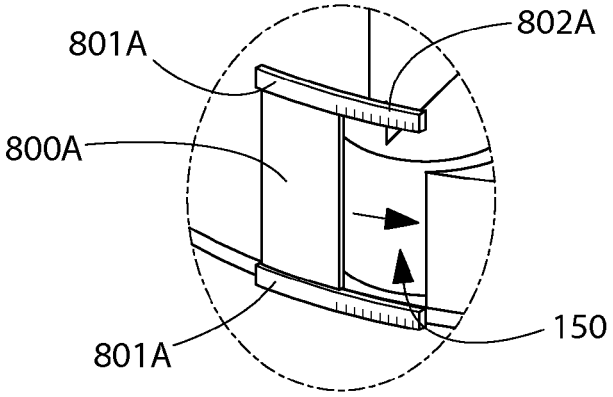
FIG. 2A is a close-up view of area II of FIG. 1 in which a throttle mechanism is illustrated that is operably coupled to an air-inlet portion of a ventilation passageway of the ventilated module, the throttle mechanism being in a wide open position in which the ventilation mechanism does not obstruct the air-inlet portion of a ventilation passageway.
Figure 2B:
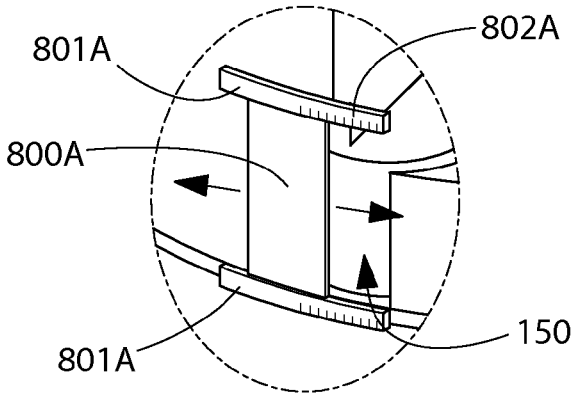
FIG. 2B is close-up view of area II of FIG. 1 in which the throttle mechanism has been moved to a position in which the ventilation mechanism obstructs thirty percent of the air-inlet portion of a ventilation passageway.
Figure 2C:
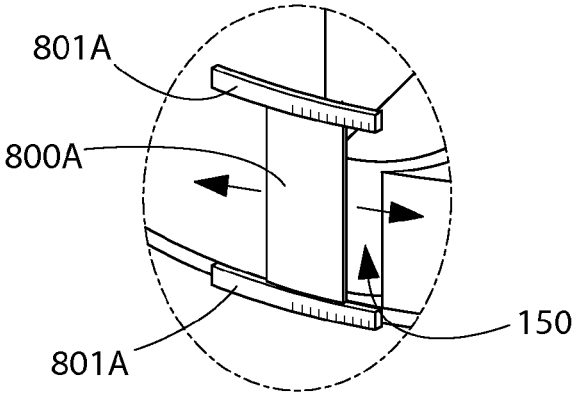
FIG. 2C is close-up view of area II of FIG. 1 in which the throttle mechanism has been moved to a position in which the ventilation mechanism obstructs sixty percent of the air-inlet portion of a ventilation passageway.

With reference now to FIGS. 1 and 2A concurrently, the details of the exemplified embodiment of the air-inlet throttle mechanism will be discussed. It should be understood that the structures and concepts discussed below with respect to the air-inlet throttle mechanism are equally applicable to the air-outlet throttle mechanism. As mentioned above, the air-inlet throttle mechanism comprises a plurality of throttle plates 800A. Each of the throttle plates 800A is adjustably coupled to the overpack body 100 by a pair of tracks 801A that extend above and below the openings of the air-inlet vents 150. The throttle plates 800A are slidably mounted within the tracks 801A so as be alterable between a plurality of selectable positions, wherein each of the selectable positions obstructs a different percentage of the air-inlet vents 150. In FIG. 2A, the throttle plates 800A are in a position in which the air-inlet vents 150 are not obstructed in any manner. In other words, the obstruction percentage of the ventilation passageway in FIG. 2A is 0%. In FIG. 2B, the throttle plates 800A are in a position in which 20% of the air-inlet vents 150 are obstructed. In other words, the obstruction percentage of the ventilation passageway in FIG. 2B is 20%. In FIG. 2C, the throttle plates 800A are in a position in which 50% of the air-inlet vents 150 are obstructed. In other words, the obstruction percentage of the ventilation passageway in FIG. 2C is 50%. Indicia 802A, in the form of line segments, are provided that visually demarcate the obstruction percentage. The throttle plates 800A can be adjusted to any desired position to achieve any desired obstruction percentage. In other embodiments, the throttle plates 800A can move along a calibrated screw mechanism to obstruct the desired percentage of airflow.

Increasing the obstruction percentage decreases the natural convective flow of the air through the ventilation passageway, thereby decreasing the heat rejection rate of the ventilated storage system 1000. As a result, the temperature of the components of the ventilated storage system 1000 is increased. To the contrary, decreasing the obstruction percentage increases the natural convective flow of the air through the ventilation passageway, thereby increasing the heat rejection rate of the ventilated storage system 1000. As a result, the temperature of the components of the ventilated storage system 1000 is decreased.

While the air-inlet throttle mechanism is exemplified as a plurality individual and independently adjustable throttle plates 800A, in other embodiments the air-inlet throttle mechanism may be structurally and/or functionally singular so that the plurality of air-inlet vents 150A are all obstructed simultaneously with a single adjustment. For example, in one embodiment, the air-inlet throttle mechanism can take the form of an annular sleeve having a plurality of windows that are circumferentially arranged about the annular sleeve in a manner that corresponds with the circumferential arrangement of the air-inlet vents 150 about the overpack body 100. This annular sleeve can be positioned so as to surround the bottom portion of the overpack body 100 so that the windows are aligned with the air-inlet vents 150. Rotation of the annular sleeve would result in concurrent selective obstruction of all of the air-inlet vents 150.

The air-inlet throttle mechanism can take on a wide variety of structural arrangements, none of which are to be considered limiting of the present invention unless specifically recited in the claims. For example, the air inlet throttle mechanism can comprise a plurality of throttle plates that are mounted within the air-inlet vents 150 on rotatable shafts. In such an embodiment, selective adjustment of the throttle plates to achieve the desired obstruction percentage is accomplished by rotating the rotatable shafts a desired angular increment. This is similar to the structural arrangement of a throttle valve, such as is found in a carburetor for an internal combustion engine. In other embodiments, for example, the air-inlet throttle mechanism can take the form of an inflatable rubber tube or balloon located within the air-inlet vents 150. In such an embodiment, selective inflation or deflation of the tube or balloon to achieve the desired obstruction percentage is accomplished by inflating or deflating the tube or balloon a desired volume. Any type of adjustable flow restrictor or valve can also be used.

Moreover, while the air-inlet throttle mechanism of the exemplified embodiment is designed so that each of the plurality of the air-inlet vents 150 is individually obstructed the desired percentage, in other embodiments the air-inlet throttle mechanism can be positioned at a location along the air-inlet position of the ventilation passageway subsequent to the convergence of the air-inlet vents 150, such as in a header before the cavity 50 or a bottom plenum of the cavity 50. Similarly, while the air-outlet throttle mechanism of the exemplified embodiment is designed so that each of the plurality of the air-outlet vents 550 is individually obstructed the desired percentage, in other embodiments the air-outlet throttle mechanism can be positioned at a location along the air-outlet position of the ventilation passageway prior to the air-inlet vents 150, such as in a top plenum of the cavity 50 or a header subsequent to the cavity 50.

The adjustment of the throttle mechanism(s) in the controlled manner can be automated or manually implemented to maintain the temperature of a desired portion of the ventilated storage system 1000 in a desired temperature range. In certain embodiments, only one or a select number of the plurality of the air-inlet vents 150 (and/or the plurality of air-outlet vents 550 may be throttled to adjust the natural convective air flow rates. Thus, it is the percent obstruction of the effective cross-sectional area of the ventilation passageway that matters in certain embodiments, not the percent obstruction of any individual air-inlet vent 150 and/or air outlet vent 550.

Figure 3:
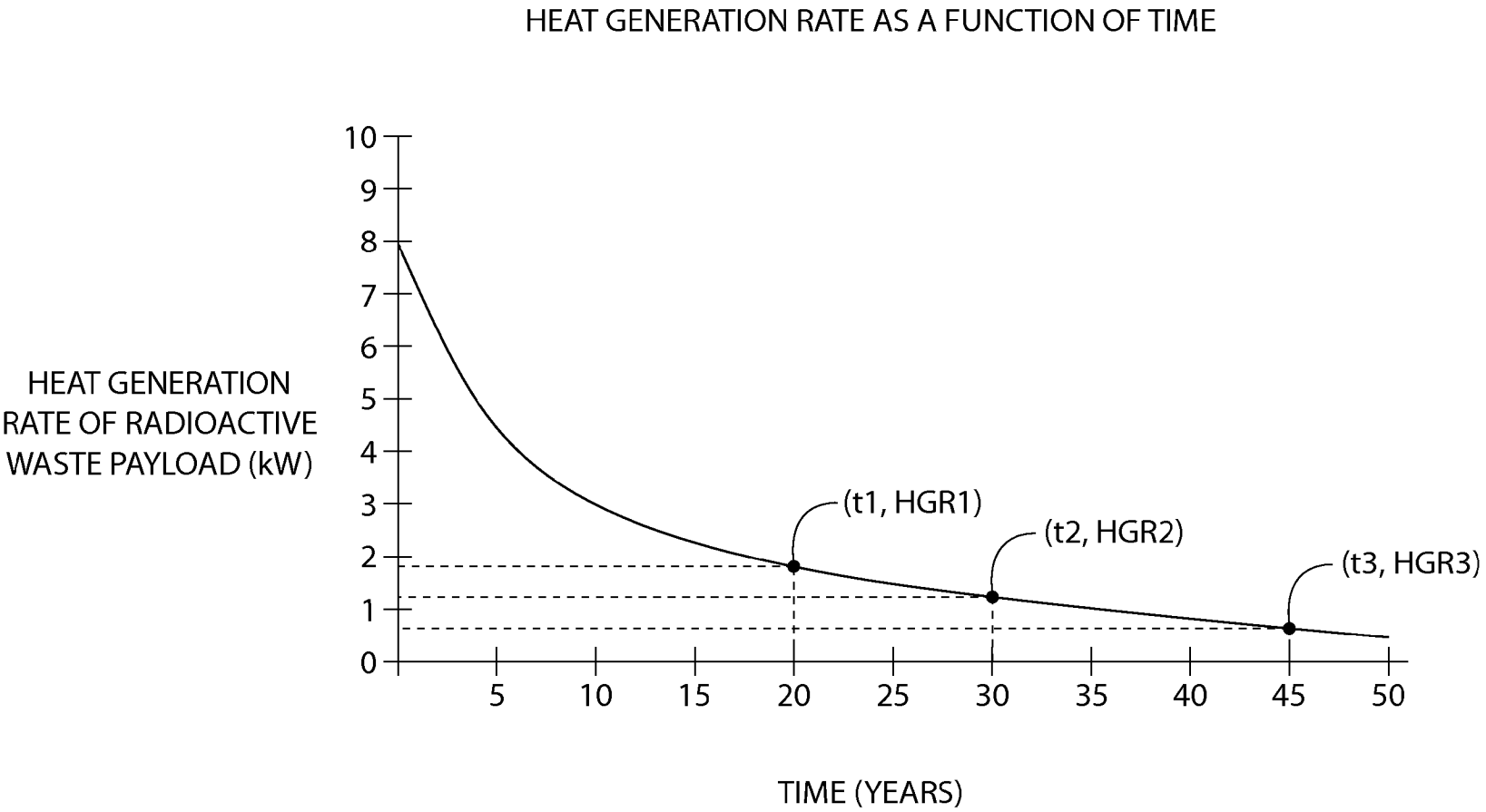
FIG. 3 is a graph of heat generation rate of radioactive waste as a function of time, in accordance with an embodiment of the present invention.
Figure 4:
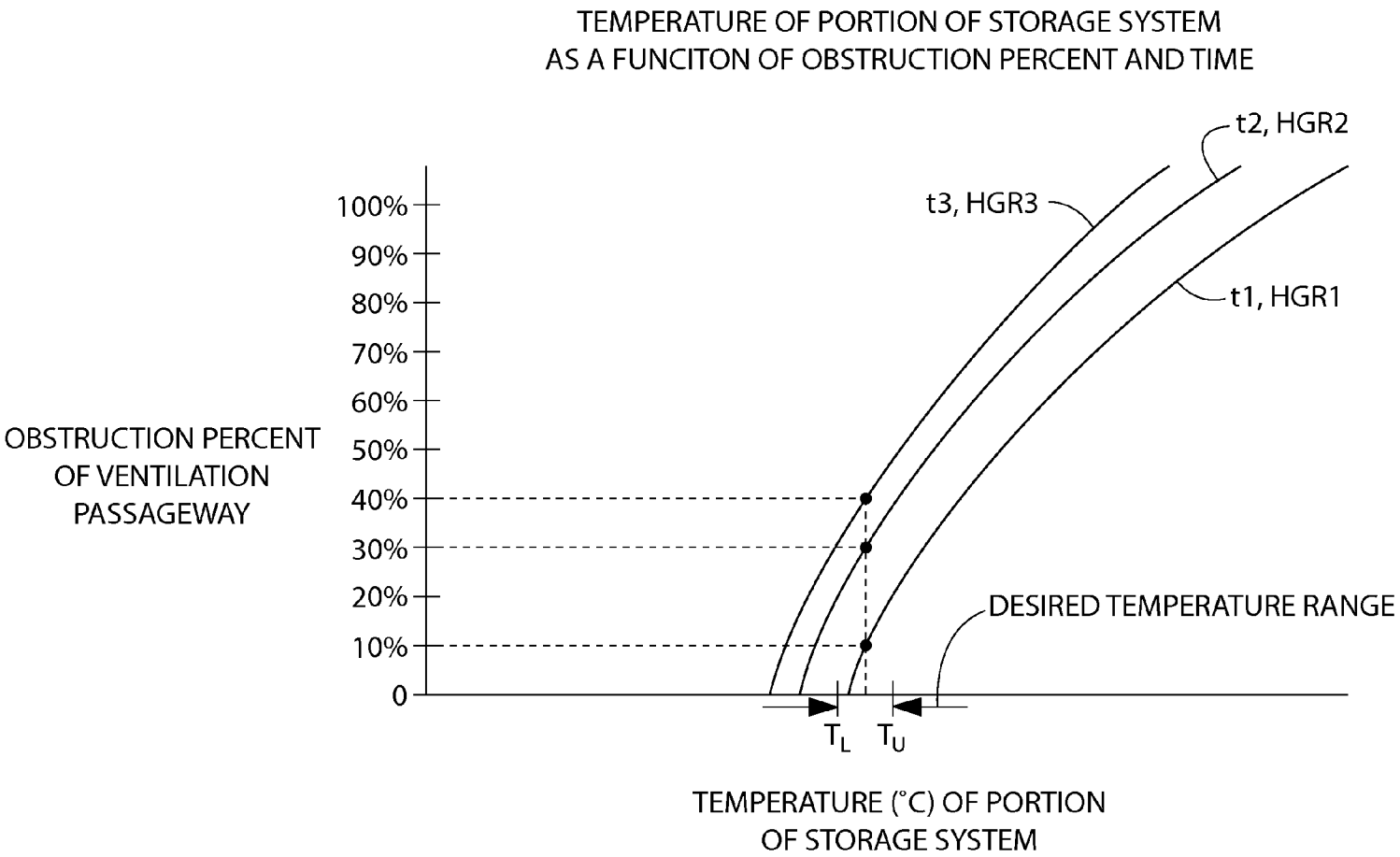
FIG. 4 is a graph of the temperature of a portion of a storage system as a function of time based on the graph of FIG. 3 and as a function of an obstruction percent of the ventilation passageway, in accordance with an embodiment of the present invention.
Figure 5:
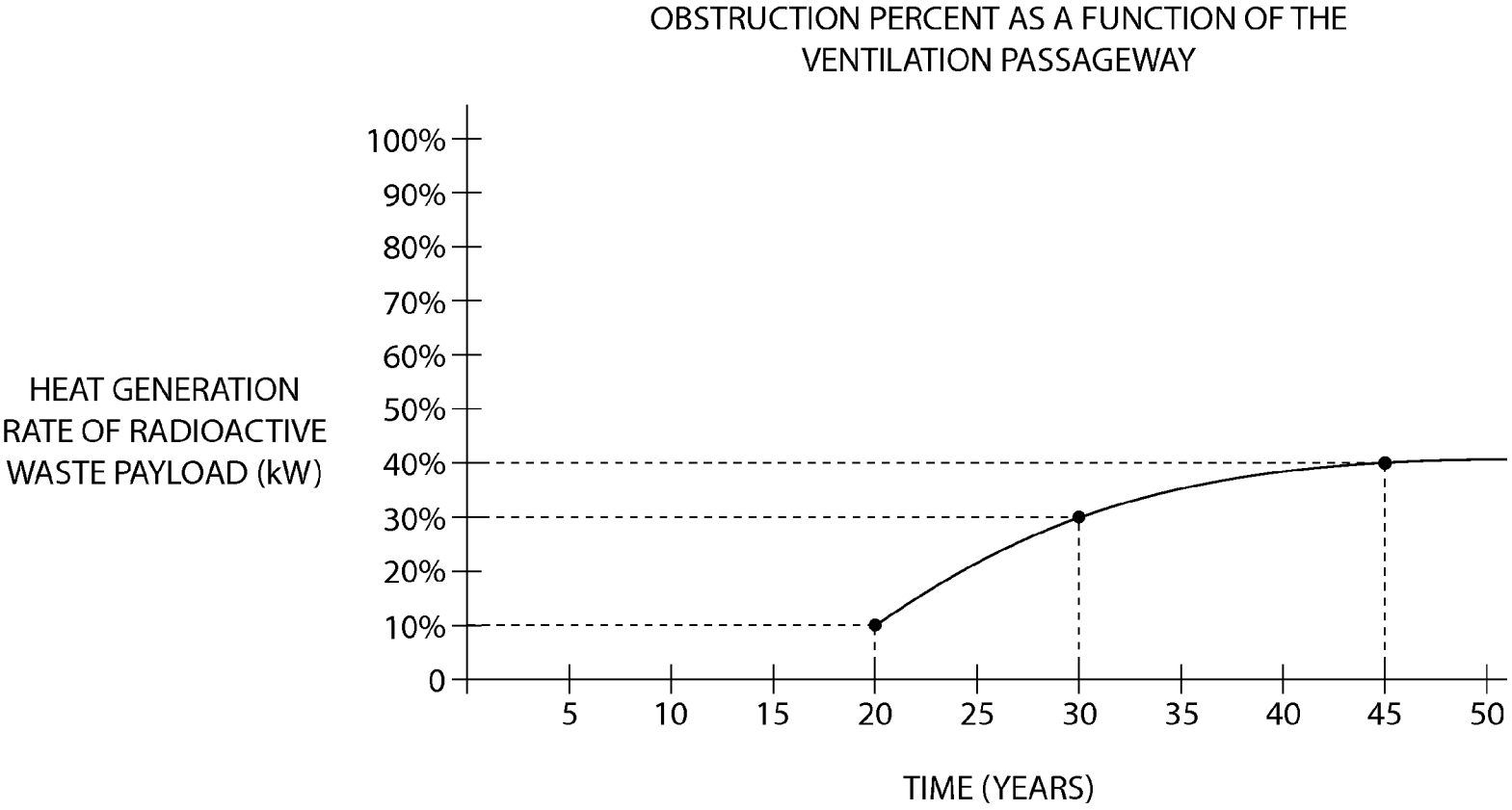
FIG. 5 is a graph of obstruction percentage as a function of time based on the graph of FIG. 4, in accordance with an embodiment of the present invention.

Referring now to FIGS. 3-5, a method of storing radioactive materials according to a method of the present invention in which throttling the natural convective flow of air through the ventilation passageway is utilized to control the temperature of a desired portion of the ventilated storage system 1000 will be discussed. While the inventive method will be discussed in relation to the ventilated storage system 1000 of FIGS. 1-2C, it is to be understood that the inventive method can be utilized in any ventilated storage system, including without limitation any of those mentioned above.

As mentioned above, in certain environments it has been found desirable to maintain a desired portion of the ventilated storage system 1000, such as the outer surface 201 of the container 200 or the outer surface 190 of the ventilated module 600, within a predetermined temperature range. For example, it is desirable to maintain the stainless steel outer surface 201 of the container 200 within a desired temperature range to minimize and/or prevent SCC. In another example, it is desirable to maintain the concrete outer surface of the ventilated module 600 within a desired temperature range to prevent freezing of moisture thereon during freeze and thaw cycles experienced in the environment.

In one embodiment, the desired temperature range is predetermined and comprises a lower threshold temperature $T_L$ and an upper threshold temperature $T_U$. In an embodiment where the portion of the ventilate storage system 100 that is desired to be controlled is a stainless steel outer surface 201 of the container 200, the lower threshold temperature $T_L$ is selected to be at or above about 85° C. In an embodiment where the portion of the ventilate storage system 100 that is desired to be controlled is the stainless steel outer surface 201 of the container 200, the lower threshold temperature $T_L$ is selected to prevent deliquesce of chlorides on the outer surface 201 of the container 200. In one such embodiment, the lower threshold temperature $T_L$ is selected to be at or above about 85° C. In an embodiment where the portion of the ventilated storage system 100 that is desired to be controlled is a concrete outer surface of the ventilated module 600, the lower threshold temperature $T_L$ is selected to prevent freezing of moisture on the outer surface of the ventilated module. In one such embodiment, the lower threshold temperature $T_L$ is selected to be at or above about 1° C. Irrespective of the embodiment, the upper threshold temperature $T_U$ is, of course, selected so as to be within safety margins.

In accomplishing the above objective, it must be taken into consideration that the heat generation rate (HGR) of the radioactive waste loaded within the container 200 decreases with time. Thus, the first step is to determine the HGR of the radioactive waste loaded in the container 200 as a function of time. A graph of HGR as a function of time is set forth in FIG. 3. The data required to generate the graph of FIG. 3 can be calculated hypothetically using a properly programmed computer modeling program or can be obtained experimentally through measurement. Of course, the exact details (empirical and curve) of the HGR of the radioactive waste loaded in the container 200 as a function of time will change from load to load. To this end, it should be noted that the data graphed in FIG. 3 is purely fictitious and is provided merely to exemplify the relationship that is to be determined. However, it is well know that the HGR of radioactive waste, such as SNF, decreases with time.

Once the HGR of the radioactive waste loaded in the container is determined as a function of time, the surface temperature of the desired portion of the ventilated storage system is determined as a function of time and as a function of obstruction percentage of the ventilation passageway, based on the relationship determined in FIG. 3 (see FIG. 4). In order to illustrate this concept, in FIG. 4, the temperature of the desired portion of the ventilated storage system 1000 is graphed as a function of blockage percent of the ventilation passageway for three different data points from FIG. 3. The lower data curve is for t1, which corresponds to 20 years and at which the radioactive waste has HGR1. The middle data curve is for t2, which corresponds to 30 years and at which the radioactive waste has HGR2. The upper data curve is for t3, which corresponds to 45 years and at which the radioactive waste has HGR3. For simplicity, FIG. 4 illustrates data curves for only three data points from FIG. 3. Of course, more data points from FIG. 3 can be graphed in FIG. 4 to obtain more reliable data and a more complete data set. It should be noted that the data graphed in FIG. 4 is purely fictitious and is provided merely to exemplify the relationships that are to be determined. Data graphs based on actual data and/or estimations will differ in both empirical data and curvature of the data plot.

Once the data curves of FIG. 4 are established, a data point on each of the three data curves is selected that falls within the predetermined desired temperature range (discussed above). As illustrated in FIG. 4, the desired temperature is selected so as to be within the middle of the predetermined desired temperature range.

Based on FIG. 4, in order to maintain the temperature of the portion of the ventilated storage system 1000 within the desired temperature range, the natural convective flow of the air through the ventilation passageway should be throttled down 10% at t1 (i.e., year 20). Thought of another way, the throttle mechanism should be adjusted so that 10% of the effective cross-sectional area of the ventilation passageway is obstructed at t1 (i.e., year 20). At t2 (i.e., year 30), in order to maintain the temperature of the portion of the ventilated storage system 1000 within the desired temperature range, the natural convective flow of the air through the ventilation passageway should be throttled down 30% (an additional 20% from t1). Thought of another way, the throttle mechanism should be adjusted so that 30% of the effective cross-sectional area of the ventilation passageway is obstructed at t2 (i.e., year 30). At t3 (i.e., year 45), in order to maintain the temperature of the portion of the ventilated storage system 1000 within the desired temperature range, the natural convective flow of the air through the ventilation passageway should be throttled down 40% (an additional 10% from t2). Thought of another way, the throttle mechanism should be adjusted so that 40% of the effective cross-sectional area of the ventilation passageway is obstructed at t3 (i.e., year 45).

Based on the data curves of FIG. 4, the percent blockage of the ventilation passageway required to maintain the portion of the ventilated storage system 1000 within the desired temperature range can be determined as a function of time (see FIG. 5). Again, the data graphed in FIG. 5 is purely fictitious and is provided merely to exemplify the relationships that are to be determined. Data graphs based on actual data and/or estimations will differ in both empirical data and curvature of the data plot.

Thus, in the fictitious example, the data curve of FIG. 5 sets forth the throttling protocol as a function of time that will maintain the desired portion of the ventilated storage system 1000 at a temperature within the desire temperature range. Once the throttling protocol is determined, the ventilation passageway is obstructed in accordance with said protocol. By throttling the natural convective flow of the air through the ventilation passageway, the heat rejection rate of the storage system is altered appropriately to compensate for the decreasing HGR of the radioactive waste to maintain the portion of the ventilated storage system 1000 within the predetermined temperature range.

Without performing the throttling of the natural convective flow of the air through the ventilation passageway in accordance with the protocol, the HGR of the radioactive waste would decrease a sufficient amount such that the temperature of the portion of the ventilate storage system 1000 would fall below the lower threshold temperature $T_L$ of the predetermined temperature range. While the predetermined temperature range is exemplified as comprising a lower and upper threshold temperature, once the HGR has decreased to a certain lower level, it may be no longer necessary to be concerned with exceeding the upper threshold temperature $T_U$. Thus, in certain embodiments of the invention, the desired temperature range may be solely dictated (and/or defined) by the lower threshold temperature $T_L$.

As discussed above, in accordance with the present invention, throttling down of the natural convective flow of air is performed to compensate for decreasing HGR of the radioactive waste loaded in the container. However, in certain embodiments of the present invention, the appropriate throttling (up or down) of the natural convective flow of the air may also take into consideration the temperature of the air ambient to the ventilated storage system 1000 (i.e., the temperature of the incoming air 3). In one embodiment, this is accomplished by utilizing an estimated temperature of the ambient air taking into consideration into average temperatures of the geographic location in which the storage system is located. Utilizing this parameter, adjustments to the projected throttling schema of FIG. 5 can be implemented that take into consideration average monthly temperatures, average seasonal temperatures, or average daily temperatures. In one embodiment, a prescribed monthly throttling program can be implemented that takes into account daily and seasonal temperature changes, the decay heat generation rate of the canister contents, the material properties and geometry of the ventilates storage system, and, the dependence of the canister and/or storage system surface temperature as a function of the percent blockage of the ventilation pathway. Furthermore, in one specific embodiment of the present invention, a temperature sensor can be utilized to provide actual ambient air temperature measurements to an automated system that adjusts the throttling amount in substantially real time.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A method of storing radioactive waste in a storage system comprising a container and a ventilated module, the method comprising:

a) positioning the container loaded with radioactive waste in the ventilated module, the ventilated module configured so that heat generated by the radioactive waste causes a natural convective flow of air through a ventilation passageway of the storage system;

b) measuring a variable associated with the heat generated by the radioactive waste loaded in the container and calculating a corresponding heat generation rate;

c) determining a temperature of air ambient to the module; and d) throttling the natural convective flow of the air through the ventilation passageway to maintain a portion of the storage system at a temperature within a predetermined range over a period of time based on the heat generation rate and temperature of air ambient to the module;

wherein the flow of air in step d) is throttled by partially obstructing the ventilation passageway.

2. The method according to claim 1 wherein the predetermined temperature range includes a lower threshold.

3. The method according to claim 2 wherein the lower threshold is equal to or greater than about 85° C.

4. The method according to claim 1 wherein step d) further comprises throttling the natural convective flow of the air through the ventilation passageway by a predetermined percentage of air flow.

5. The method according to claim 4 wherein the predetermined percentage is based on the heat generation rate of the radioactive waste as a function of time.

6. The method according to claim 4 wherein the predetermined percentage is based on: (1) the heat generation rate of the radioactive waste as a function of time; and (2) the temperature of air ambient to the ventilated module.

7. The method according to claim 6 wherein the temperature of the air ambient to the ventilated module determined in step c) is an average temperature taking into consideration average temperatures of the geographic location in which the storage system is located.

8. The method according to claim 4 wherein step d) further comprises throttling down the natural convective flow of the air through the ventilation passageway by the predetermined percentage by blocking a predetermined percentage of an air-inlet portion of the ventilation passageway.

9. The method according to claim 4 wherein step d) further comprises throttling down the natural convective flow of the air through the ventilation passageway by the predetermined percentage by blocking a predetermined percentage of an air-outlet portion of the ventilation passageway.

10. The method according to claim 1 wherein the portion is an outer surface of the container, and a lower threshold of the predetermined range is selected to prevent deliquesce of chlorides on the outer surface of the container, the outer surface of the container comprising stainless steel.

11. The method according to claim 1 wherein the portion is an outer surface of the ventilated module, and a lower threshold of the predetermined range is selected to prevent freezing of moisture on the outer surface of the ventilated module.

12. A method of controlling temperature of a portion of a storage system comprising a container loaded with radioactive waste and a ventilated module in which the container is positioned, the ventilated module configured so that heat generated by the radioactive waste causes a natural convective flow of air through a ventilation passageway of the ventilated module, the method comprising:

a) determining a desired temperature range of the portion of the storage system;

b) measuring a variable associated with the heat generated by the radioactive waste loaded in the container;

c) determining an ambient air temperature surrounding the module;

d) determining a heat generation rate of the radioactive materials as a function of time based on the measured variable;

e) determining, based on the results of step a), a temperature of the portion of the storage system as a function of time and as a function of an obstruction percent of the ventilation passageway; and d) obstructing the ventilation passageway in accordance with the functions of step e) to maintain the portion of the storage system within the desired temperature range.

13. A method of controlling temperature of a portion of a storage system comprising a container loaded with radioactive waste and a ventilated module in which the container is positioned, the ventilated module configured so that heat generated by the radioactive waste causes a natural convective flow of air through a ventilation passageway of the ventilated module, the method comprising: throttling the natural convective flow of the air through the ventilation passageway to alter a heat rejection rate of the storage system to compensate for a decreasing heat generation rate of the radioactive waste to maintain the portion of the storage system within a predetermined temperature range.

14. The method according to claim 13 wherein the predetermined temperature range has a lower threshold and an upper threshold.

15. The method according to claim 14 wherein the portion of the storage system is an outer surface of the container, and wherein the lower threshold is selected to prevent deliquesce of airborne contaminants on the outer surface of the container.

16. The method according to claim 15 wherein the airborne contaminants comprise chlorides and the outer surface of the container comprises stainless steel.

17. The method according to claim 14 wherein the lower threshold is at or above 85° C.

18. The method according to claim 13 wherein the portion of the storage system is an outer surface of the ventilated module, and wherein the lower threshold is selected to prevent freezing of moisture on the outer surface of the ventilated module.

19. The method according to claim 18 wherein the outer surface of the ventilated module comprises concrete.

20. The method according to claim 13 wherein the radioactive waste comprises spent nuclear fuel, the container is a multi-purpose canister forming a fluidic containment boundary about the spent nuclear fuel, and the ventilated module provides radiation shielding for the spent nuclear fuel.

21. The method according to claim 13 wherein said throttling further comprises throttling down the natural convective flow of the air through the ventilation passageway by obstructing a predetermined percentage of an air-inlet portion of the ventilation passageway.

22. The method according to claim 13 wherein said throttling further comprises throttling down the natural convective flow of the air through the ventilation passageway by obstructing a predetermined percentage of an air-outlet portion of the ventilation passageway.

23. A system for storing radioactive waste comprising:

a ventilated module;

a container loaded with radioactive waste positioned within the ventilated module, the ventilated module configured so that heat generated by the radioactive waste causes a natural convective flow of air through a ventilation passageway of the ventilated module; and a throttle mechanism operably coupled to the ventilation module to throttle the natural convective flow of the air through the ventilation passageway;

the throttle mechanism being movable from a fully open position to a fully closed position, and infinitely adjustable in a continuum of a plurality of partially closed positions therebetween in which the ventilation passageway is partially obstructed by the throttle mechanism.

24. The system according to claim 23 wherein the throttle mechanism comprises a plate that is selectably adjustable to the fully open position, the fully closed position, and the partially closed positions therebetween.

25. The system according to 23 wherein the throttle mechanism is configured to throttle the natural convective flow of the air at a location along an air-inlet portion of the ventilation passageway.

26. The system according to claim 23 wherein the throttle mechanism is configured to throttle the natural convective flow of the air at a location along an air-outlet portion of the ventilation passageway.

* * * * *